US012642344B2

(12) United States Patent
Lee et al.

(10) Patent No.: US 12,642,344 B2
(45) Date of Patent: Jun. 2, 2026

(54) COMPACT COSMETIC CASE USING A FLEXIBLE MEMBRANE

(71) Applicant: SAMHWA CO., LTD, Uiwang-si (KR)

(72) Inventors: Kyungchang Lee, Uiwang-si (KR); Jieun Sim, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 272 days.

(21) Appl. No.: 18/501,233

(22) Filed: Nov. 3, 2023

(65) Prior Publication Data

US 2025/0098839 A1 Mar. 27, 2025

(30) Foreign Application Priority Data

Sep. 26, 2023 (KR) ..... 10-2023-0128733

(51) Int. Cl.
*A45D 40/22* (2006.01)

(52) U.S. Cl.
CPC ..... *A45D 40/222* (2013.01); *A45D 2040/224* (2013.01)

(58) Field of Classification Search
CPC .. A45D 40/0075; A45D 40/22; A45D 40/222; A45D 33/006; A45D 33/008; A45D 33/003; A45D 33/005; A45D 33/02; A45D 33/025; A45D 33/04; A45D 33/06; A45D 33/16; A45D 33/08; A45D 33/12; A45D 33/14; A45D 33/34; A45D 2040/0012; A45D 2040/224
See application file for complete search history.

(56) References Cited

PUBLICATIONS

Clarivate Analytics copyrighted translation of KR20180025541A; publication date Mar. 9, 2018 (Year: 2018).*
Clarivate Analytics copyrighted translation of TWM556508U; publication date Mar. 11, 2018 (Year: 2018).*
Clarivate Analytics copyrighted translation of WO201600071; international filing date May 18, 2016 (Year: 2016).*
Clarivate Analytics copyrighted translation of KR101915152B1; publication date Dec. 28, 2018 (Year: 2018).*
Clarivate Analytics copyrighted translation of WO2018/143766A1; international filing date Feb. 6, 2018 (Year: 2018).*

* cited by examiner

*Primary Examiner* — Edelmira Bosques
*Assistant Examiner* — Sarah Woodhouse
(74) *Attorney, Agent, or Firm* — Bridgeway IP Law Group, PLLC; Jihun Kim

(57) ABSTRACT

A compact cosmetic case that uses a flexible membrane is disclosed. The compact cosmetic case includes: a container body, on an inner side of which a holding space having an open top is formed; a rubber member that is coupled to the container body and includes a membrane part, which is configured to cover the open top of the holding space, is made from a material capable of elastic deformation, and in which a slit is formed; and a mesh member that is arranged over the membrane part and has multiple pores formed therein, with the mesh member configured such that a portion thereof is secured to the container body, where a pressure applied from above on the membrane part can cause a change in at least one of the shape and size of the slit.

7 Claims, 11 Drawing Sheets

COMPACT COSMETIC CASE USING A FLEXIBLE MEMBRANE

CROSS-REFERENCE TO RELATED APPLICATIONS

This application claims the benefit of Korean Patent Application No. 10-2023-0128733, filed with the Korean Intellectual Property Office on Sep. 26, 2023, the disclosure of which is incorporated herein by reference in its entirety.

BACKGROUND

1. Technical Field

The present invention relates to a cosmetic container, more particularly to a compact cosmetic case that uses a flexible membrane.

2. Description of the Related Art

A typical compact container holds a content in the form of a powder, which may be dabbed onto a puff for application. Since the content held in such compact container is provided in the form of a powder, there is a risk of the powder content being dispersed in the air or otherwise undesirably sticking to nearby objects.

To minimize this risk, many compact containers include an upper case that functions as a lid and a lower case that holds the content, where a puff is placed over the content of the lower case to suppress any movement of the powder content. However, when the content is being used, the powder content is completely exposed to the exterior, and there is a high risk of the content sticking to a nearby object. The problem of contaminating its surroundings can be especially severe when the content is spilled out, for example when the compact container is opened unintentionally while not in use or when an unexpected impact is applied on the compact container while in use.

To overcome this problem, some compact containers hold the powder content in a solidly compressed form. In such cases, the content is compressed into the form of a pressed powder, and there is a lower risk of the content being spilt or dispersed into the air. However, there are also drawbacks in that it is difficult to dab the powder with a puff and that the powder may not be evenly applied onto the puff.

SUMMARY OF THE INVENTION

An aspect of the present invention, which was conceived to resolve the problem described above, is to provide a compact cosmetic case from which the content is not easily removed unless by user manipulation.

Other objectives of the present invention will be more clearly understood from the embodiments set forth below.

One aspect of the present invention provides a compact cosmetic case that includes: a container body, on an inner side of which a holding space having an open top is formed; a rubber member that is coupled to the container body and includes a membrane part, which is configured to cover the open top of the holding space, is made from a material capable of elastic deformation, and in which a slit is formed; and a mesh member that is arranged over the membrane part and has multiple pores formed therein, with the mesh member configured such that a portion thereof is secured to the container body, where a pressure applied from above on the membrane part can cause a change in at least one of the shape and size of the slit.

A compact cosmetic case according to an embodiment of the invention can include one or more of the following features. For example, the slit can be formed in a radial shape with respect to a designated point of the membrane part serving as a center, and the membrane part can have an increased thickness at the designated point.

The compact cosmetic case can further include a lid member that is coupled to an upper portion of the container body and in which an access hole is formed in the middle, with the lid member coupled such that the access hole is above the holding space, where a portion of the mesh member can be secured between the lid member and the container body, and a multiple number of downwardly protruding spike protrusions can be formed on a lower portion of the lid member at portions contacting the mesh member.

The compact cosmetic case can further include a lower case coupled to the container body and an upper case separably coupled to the lower case. In cases where the compact cosmetic case further includes a base member coupled to a lower portion of the container body to close the bottom of the holding space, an opening can be formed in a lower portion of the lower case, and the base member can be coupled to the lower portion of the container body through the opening of the lower case.

In cases where the compact cosmetic case further includes a base member coupled to a lower portion of the container body to close the bottom of the holding space, the rubber member can be configured such that a portion of the rubber member is secured between the container body and the base member.

The compact cosmetic case can further include an immersion member that is arranged within the holding space, where a liquid content can be immersed in the immersion member. In this case, a hydrophobic treatment can be applied to the portion of the mesh member arranged over the membrane part.

An embodiment of the present invention having the features above can provide various advantageous effects including the following. However, an embodiment of the present invention may not necessarily exhibit all of the effects below.

An embodiment of the invention can prevent the content stored in the holding space from easily spilling out when the user is not using the content and can allow the content to be easily dispensed only when desired by the user.

Also, an embodiment of the invention can provide a compact cosmetic case in which the components can be coupled to one another in a secure and watertight manner and can be coupled with relative ease.

DETAILED DESCRIPTION OF THE INVENTION

Figure 1:
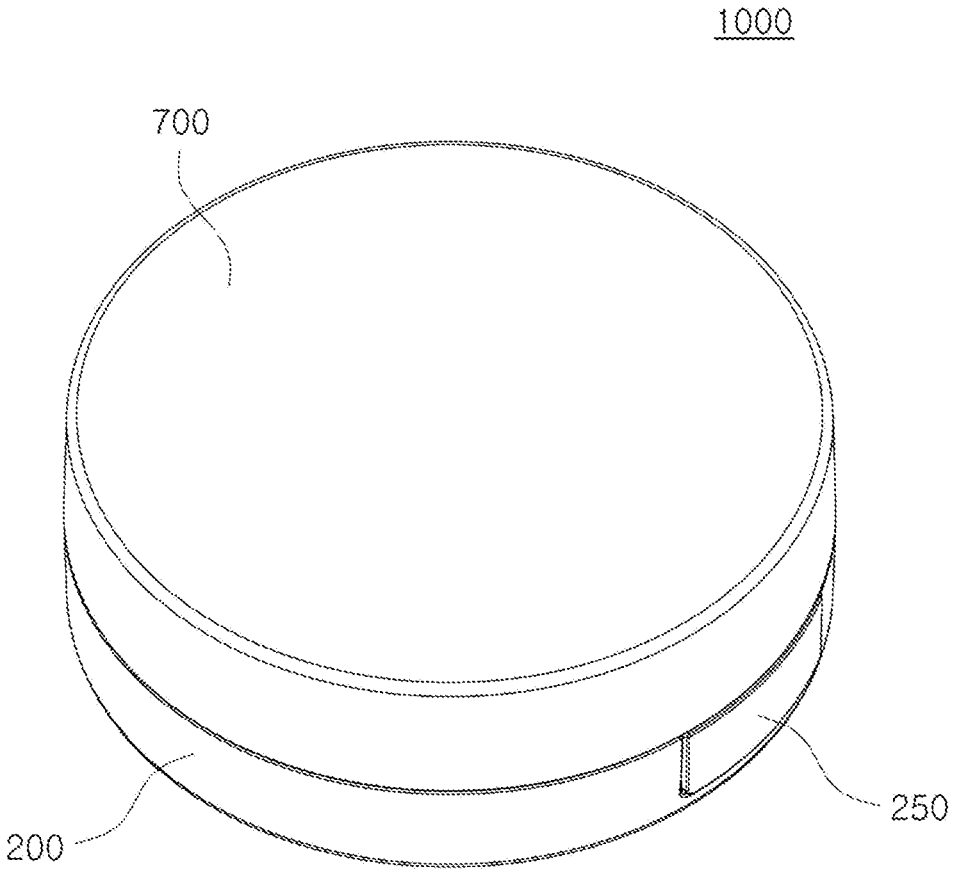
FIG. 1 is a perspective view illustrating the exterior of a compact cosmetic case according to an embodiment of the invention as seen from above.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

For the sake of convenience, the present specification uses terms such as "front", "rear", "inner side", "outer side", "upper side" and "lower side". In the descriptions that follow, "front" refers to the side where the push button 250 is formed in the compact cosmetic case 1000 illustrated in the drawings, and "rear" refers to the side where the hinge 740 of the upper case 700 is formed in the compact cosmetic case 1000 illustrated in the drawings. The "inner side" refers to a direction closer to the interior of the compact cosmetic case 1000, while the "outer side" refers to a direction further away from the interior of the compact cosmetic case 1000. The "upper" and "lower" sides are referred to with respect to a compact cosmetic case 1000 arranged as in FIG. 4. Of course, when a compact cosmetic case 1000 according to an embodiment of the invention is actually being used, the upper and lower directions mentioned in the specification may not necessarily coincide with the actual upper and lower directions.

A compact cosmetic case 1000 according to an embodiment of the invention can hold a content in an interior holding space 205 and can be configured to provide the content through slits 355 formed in a membrane part 350 made of a flexible material when the user presses the membrane part 350 with a puff 650, etc. The content held in the holding space 205 can be of a powder form but can also be provided in the form of any one of a gel, cream, and liquid.

Figure 2:
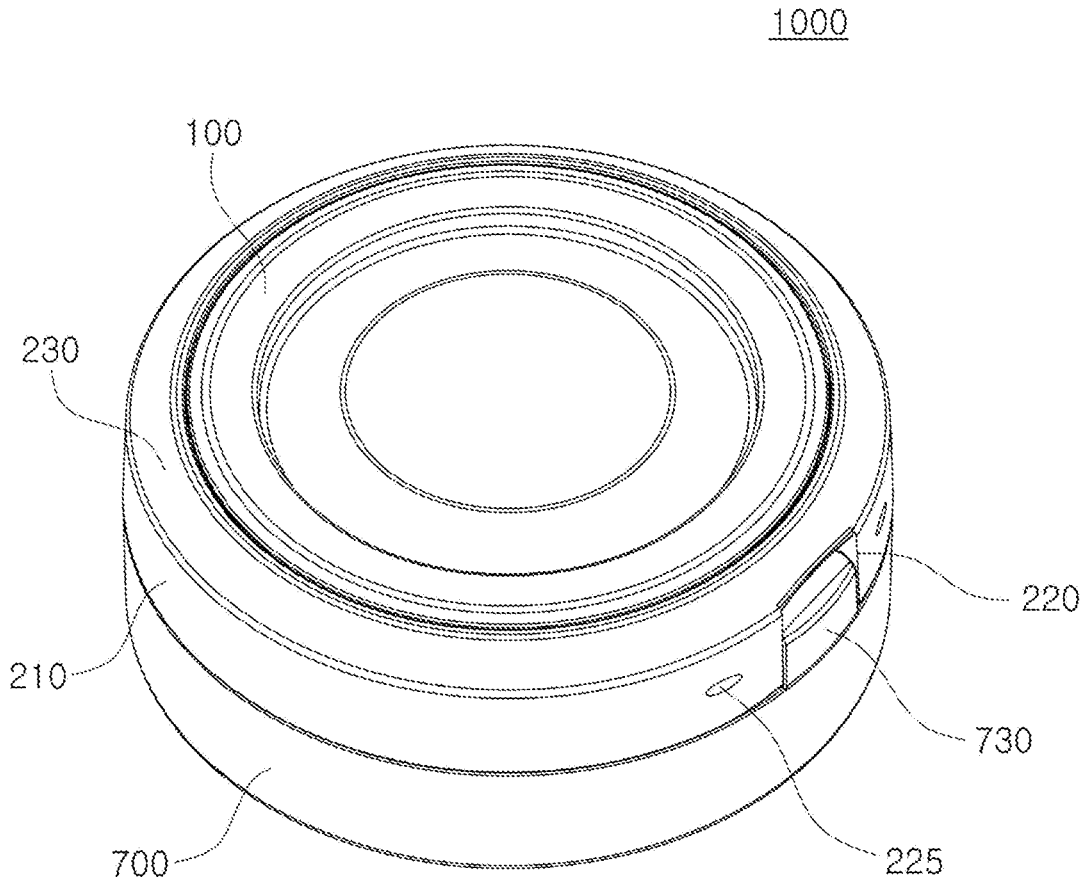
FIG. 2 is a perspective view illustrating the exterior of a compact cosmetic case according to an embodiment of the invention as seen from below.
Figure 3:
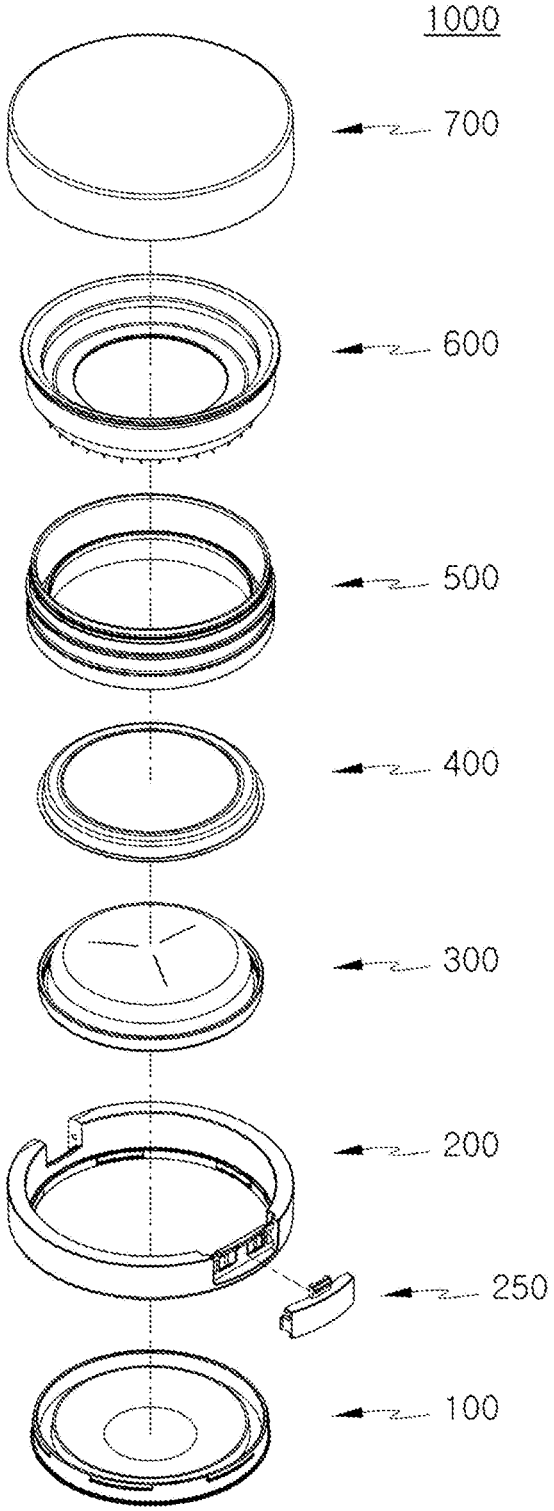
FIG. 3 is an exploded perspective view illustrating a compact cosmetic case according to an embodiment of the invention.
Figure 4:
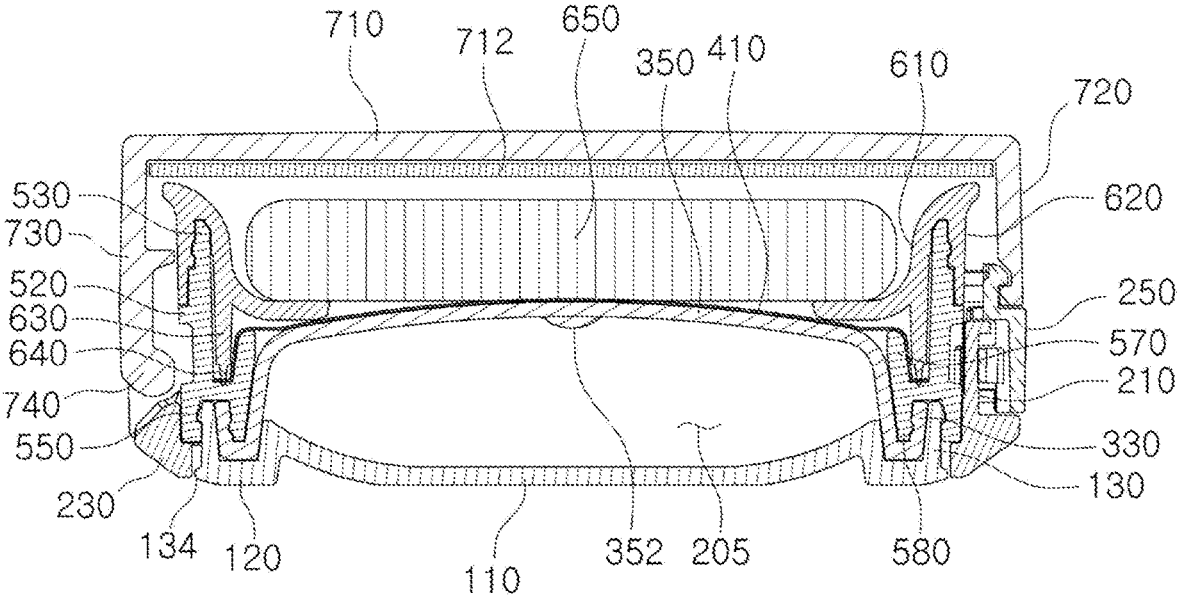
FIG. 4 is a cross-sectional view illustrating a compact cosmetic case according to an embodiment of the invention.

FIG. 1 and FIG. 2 are perspective views illustrating the exterior of a compact cosmetic case 1000 according to an embodiment of the invention. FIG. 3 is an exploded perspective view illustrating a compact cosmetic case 1000 according to an embodiment of the invention, and FIG. 4 is a cross-sectional view illustrating a compact cosmetic case 1000 according to an embodiment of the invention. FIGS. 5 through 11 illustrate certain components of the compact cosmetic case 1000 in more detail.

Referring to FIGS. 1 to 11, a compact cosmetic case 1000 according to an embodiment of the invention can mainly include a base member 100, a lower case 200, a rubber member 300, a mesh member 400, a container body 500, a lid member 600, and an upper case 700.

Figure 5:
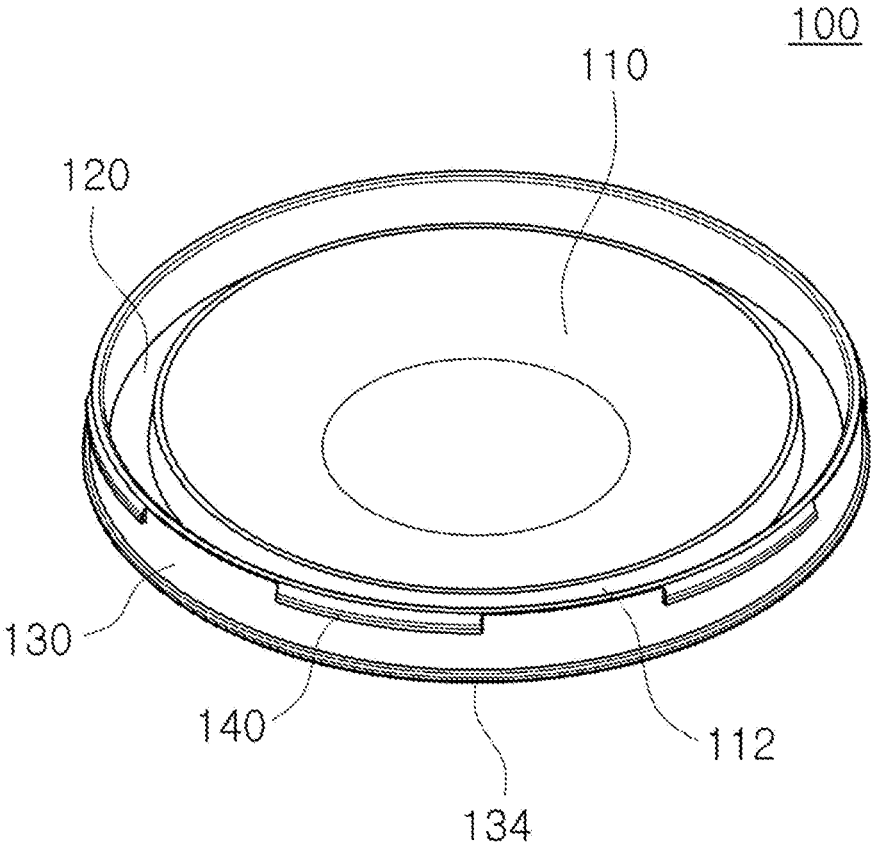
FIG. 5 is a perspective view illustrating the base member of a compact cosmetic case according to an embodiment of the invention.

The base member 100 can be coupled to a lower portion of the container body 500 to close off the bottom of the holding space 205. Referring to FIG. 5, the base member 100 can include a holder part 110, a flange part 120, and a coupling rim 130.

The holder part 110 corresponds to the part forming the bottom of the holding space 205. As illustrated in FIG. 4, an upper portion of the holder part 110 can have a concave shape in the middle, which can induce the content (not shown) within the holding space 205 to gather at the middle and suppress the content (not shown) from moving towards the coupling portions between the base member 100 and other components.

The flange part 120 can be formed to protrude outward from the edge of the holder part 110. More specifically, the flange part 120 can protrude outwardly from a lower portion of an inner curb 112, which extends downward from the edge of the holder part 110. The inner curb 112 can have an inclined cross section that spreads outwardly towards the bottom.

As illustrated in FIG. 4, when the base member 100 is coupled to the container body 500, the flange part 120 can support the lower end of the rubber member 300, and the inner curb 112 can press the lower portion on the inner side of the rubber member 300 towards in an outwardly direction. In this way, the inner curb 112 and the flange part 120 can press the rubber member 300 between the base member 100 and the container body 500, so that the holding space 205 formed between the membrane part 350 and the holder part 110 may be sealed in a watertight manner.

The coupling rim 130 can be formed to protrude upward from the edge of the flange part 120 and can be used to couple the base member 100 onto the container body 500. One or more coupling protrusions 140 can be formed on the outer perimeter of the coupling rim 130, and these can be inserted into coupling indentations formed in the inner perimeter of the lower rim 550 of the container body 500.

As illustrated in FIG. 4, when the base member 100 is coupled to the container body 500, the coupling rim 130 of the base member 100, together with the coupling rim 330 of the rubber member 300, can be forcibly inserted between the lower rim 550 of the container body 500 and the lower end 580 of the inner rim 570. The coupling rim 130 of the base member 100 can have an inclined cross section that spreads outwardly towards the top, and the coupling rim 330 of the rubber member 300 can likewise have an inclined cross section that spreads outwardly towards the top. Such structure allows the coupling rim 130 of the base member 100 to be easily inserted between the coupling rim 330 of the rubber member 300 and the lower rim 550 of the container body 500 while the rubber member 300 is in a coupled state with respect to the container body 500. The material of the base member 100 can also be chosen such that there is no excessive friction between the coupling rim 130 of the base member 100 and the coupling rim 330 of the rubber member 300. In cases where silicone is used for the rubber member 300, the base member 100 can be fabricated from a polypropylene (PP) material, etc.

As illustrated in FIG. 4, the base member 100 can be inserted through the opening 235 in the bottom of the lower case 200 and coupled to the container body 500. An annularly shaped finishing protrusion 134 that protrudes outward can be provided at a lower portion of the coupling rim 130, where the finishing protrusion 134 can fill in the gap between the base member 100 and the lower case 200.

Although the drawings show an example in which a separate base member 100 is coupled to the container body 500, it is possible to fabricate the base member 100 and the container body 500 as portions of a single integrated component in certain embodiments of the invention. However, if the compact cosmetic case 1000 includes a base member 100 that is coupled to the container body 500, there is the advantage that the content (not shown) can be filled in the holding space 205 with relative ease while the rubber member 300 and the mesh member 400 are arranged in their correct positions before the base member 100 is coupled on, when the compact cosmetic case 1000 is being assembled or refilled with new content.

Figure 6:
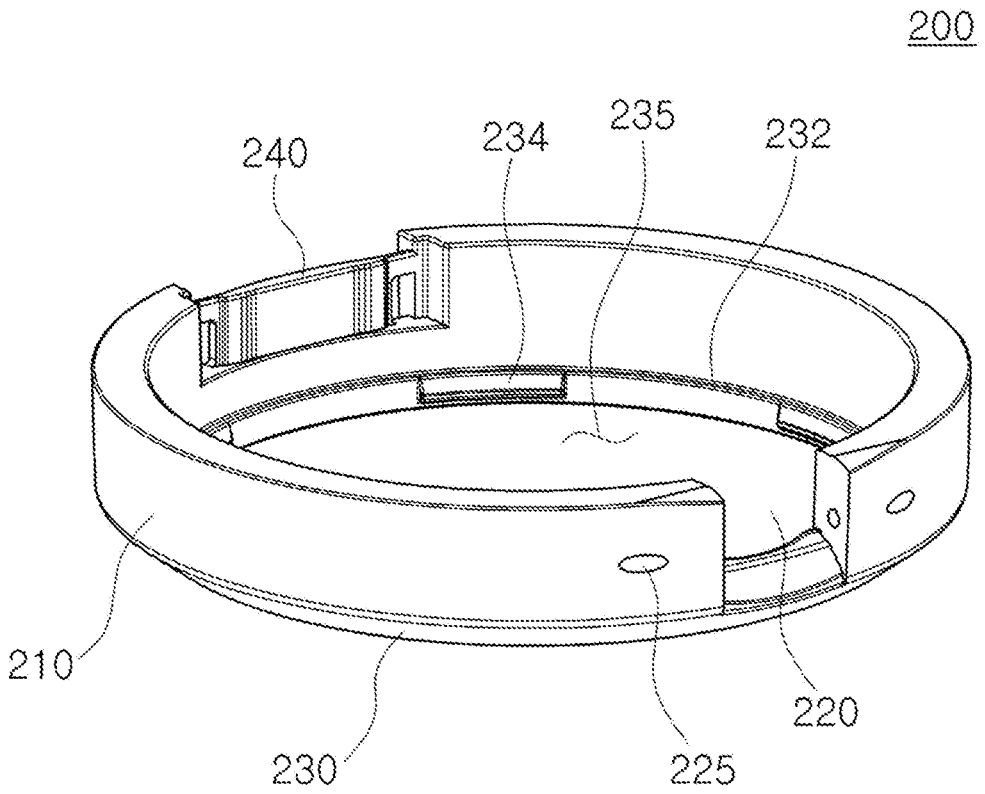
FIG. 6 is a perspective view illustrating the lower case of a compact cosmetic case according to an embodiment of the invention.

The lower case 200 can be coupled to the container body 500 and, together with the upper case 700, can form the exterior of the compact cosmetic case 1000. Referring to FIG. 6, the lower case 200 can include a side wall 210, a support part 230, and a button-mounting part 240.

The side wall 210 can form the side surface of the lower case 200 and can be formed to surround the outer side of the container body 500. In the rear side of the side wall 210, a clearance indentation 220 can be formed for the hinge-connecting part 730 of the upper case 700, and coupling holes 225 can be formed through which a hinge pin (not shown) for coupling the hinge 740 of the upper case 700 may pass through. Also, in the front side of the side wall 210, a mounting part 240 for mounting the push button 250 can be provided.

The support part 230 can be formed on a lower portion of the side wall 210 and can help the base member 100 and container body 500 to remain secured to the lower case 200 in a stable manner. On the inner side of the support part 230, a step 232 can be formed as the inner diameter is slightly decreased, and the lower rim 550 of the container body 500 can be placed on the step 232. Securing protrusions 234 can also be formed on the inner side of the support part 230, and as the securing protrusions 234 are placed on the finishing protrusion 134 of the base member 100, the base member 100 and the lower case 200 can be secured to each other in a stable manner.

The button-mounting part 240 corresponds to the part on the front side of the side wall 210 onto which the push button 250 is mounted. The button-mounting part 240 can include coupling holes for securing the push button 250 and can also include a portion for supporting the push button 250 in an outward direction as the push button 250 is pressed inward. While the button-mounting part 240 can be provided on the front side of the compact cosmetic case 1000, it is possible to form the button-mounting part 240 at another position of the side wall 210.

The push button 250 corresponds to a button that is pressed by the user when the user wishes to open the upper case 700. The push button 250 can be mounted on the button-mounting part 240. The push button 250 can be coupled to the button-mounting part 240 by way of an elastic member and can move within a designated range when pressed by the user. The elastic member can be a separate component or can be a portion of the push button 250. The push button 250 can also include detent protrusions that prevent the push button 250 from becoming detached from the button-mounting part 240 and a release protrusion that secures the upper case 700 when the push button 250 is not being pressed. When the user presses the push button 250, the push button 250 may move inward, causing the release protrusion to move inward as well. Thus, the release protrusion may no longer restrain the upper case 700, and the upper case 700 can be opened by the user.

Figure 7:
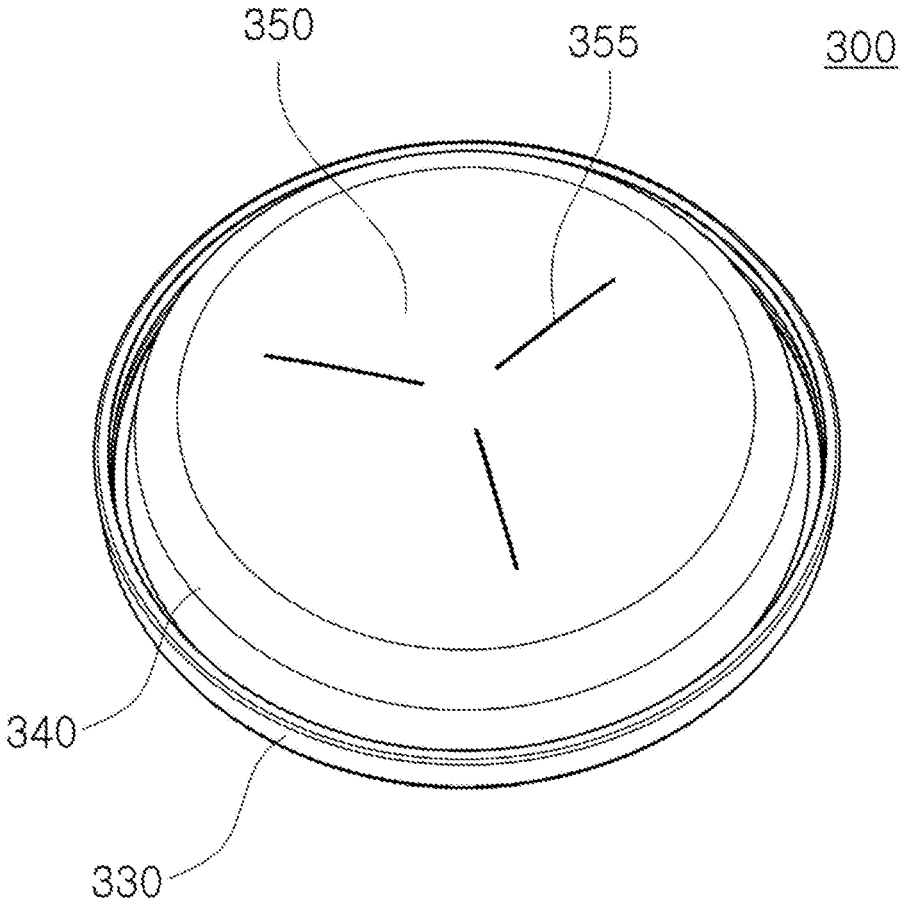
FIG. 7 is a perspective view illustrating the rubber member of a compact cosmetic case according to an embodiment of the invention as seen from above.
Figure 8:
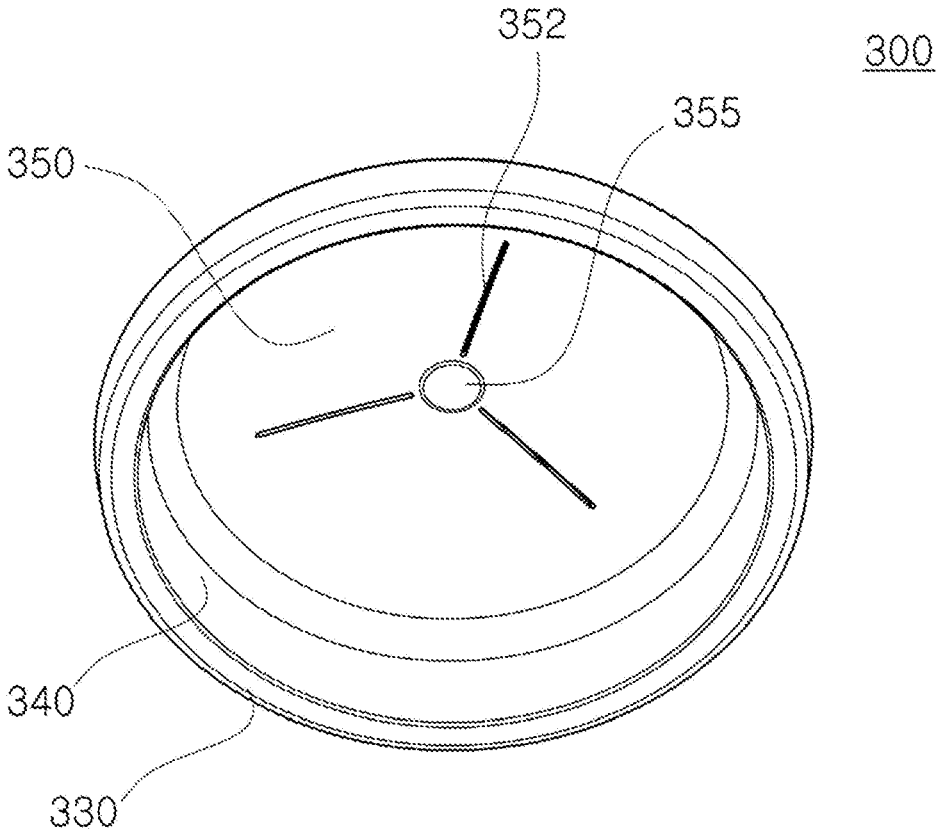
FIG. 8 is a perspective view illustrating the rubber member of a compact cosmetic case according to an embodiment of the invention as seen from below.

The rubber member 300 is a component that includes the membrane part 350, which is the part pressed by the user to allow use of the content (not shown). The rubber member 300 can be coupled to the container body 500 such that the membrane part 350 covers the open top of the holding space 205. Referring to FIG. 7 and FIG. 8, the rubber member 300 can include a coupling rim 330, a support wall 340, and the membrane part 350. Incidentally, FIG. 7 shows the rubber member 300 from above, while FIG. 8 shows the rubber member 300 from below.

The coupling rim 330 may be formed along the edge of the rubber member 300 to be used for coupling and securing the rubber member 300. As described above, when the base member 100 is coupled to the container body 500, the coupling rim 330 of the rubber member 300 and the coupling rim 130 of the base member 100 can be forcibly inserted between the lower rim 550 of the container body 500 and the lower end 580 of the inner rim 570. The coupling rim 330 of the rubber member 300 can have an inclined cross section that spreads outwardly towards the top, in a manner similar to that of the coupling rim 130 of the base member 100.

Although the coupling rim 330 of the rubber member 300 does not necessarily have to be made from the same material as that of the membrane part 350, there may be advantages to forming the coupling rim 330 from the same flexible material used for the membrane part 350. If the coupling rim 330 is made from a material such as silicone, etc., for example, the coupling rim 330 can be elastically compressed when pressed in-between the base member 100 and the container body 500, and this can not only allow an easier coupling of the base member 100 but can also provide a stronger seal.

The support wall 340 can extend downward from the edge of the membrane part 350, and the lower end of the support wall 340 can be connected to the lower end of the coupling rim 330. The support wall 340 can support the membrane part 350 such that the support wall 340 surrounds the side parts of the holding space 205 and the membrane part 350 covers the top of the holding space 205. A lower portion of the support wall 340 can be pressed by the inner curb 112 of the base member 100 against the inner perimeter of the inner rim 570 of the container body 500.

Although the support wall 340 of the rubber member 300 does not necessarily have to be made from the same material as that of the membrane part 350, there may be advantages to forming the support wall 340 from the same flexible material used for the membrane part 350. If the support wall 340 is made from a material such as silicone, etc., for example, the support wall 340 can be elastically compressed when pressed in-between the base member 100 and the container body 500, and this can not only allow an easier coupling of the base member 100 but can also provide a stronger seal.

The membrane part 350 is the part that covers the open top of the holding space 205. The membrane part 350 can be fabricated from a material that is capable of elastic deformation. Thus, the membrane part 350 can be deformed by a force applied by the user and can return to its original state when the external force is removed. The membrane part 350 can be made, for example, from a material such as silicone, etc.

One or more slits 355 can be formed in the membrane part 350. Although FIG. 7 and FIG. 8 are illustrated with the slits 355 emphasized for greater visibility, the slits 355 can have a very small width in a preferred embodiment of the invention, and when the membrane part 350 it not being pressed, the membrane part 350 on both sides of a slit 355 can practically maintain contact. Thus, while the membrane part 350 is not in a pressed state, the content (not shown) held in the holding space 205 may not easily pass through the slits 355.

As illustrated in FIG. 7 and FIG. 8, an embodiment of the invention can have the slits 355 formed radial shapes with respect to a designated point of the membrane part 350 (e.g., the center of the membrane part 350). A reinforced portion 352 can be formed at the designated point corresponding to the center of the slits 355, as in the example illustrated in FIG. 8. The reinforced portion 352, which may correspond to a portion of the membrane part 350 having an increased thickness, can help the membrane part 350 maintain a high level of strength at the position where the multiple slits 355 are gathered together.

When the user presses the membrane part 350 with a puff 650 to use the content (not shown), the membrane part 350 made from a flexible material can undergo elastic deformation and move downward. At this time, the slits 355 formed in the membrane part 350 can experience changes in at least one of their shape and size. That is, as the membrane part 350 is deformed, the shapes and sizes of the slits 355 can also be changed. Since the shapes and sizes of the slits 355 are changed when the membrane part 350 is moved downward, the content held in the holding space 205 can pass through the slits 355 and be provided over the membrane part 350.

Although the example illustrated in the drawings has the rubber member 300 including the coupling rim 330, support wall 340, and membrane part 350, it is possible for another embodiment to have either one or both of the coupling rim 330 and the support wall 340 omitted. For example, in one embodiment of the invention, the rubber member 300 can include the membrane part 350 only, which may be coupled directly onto the base member 100 and/or the container body 500.

Figure 9:
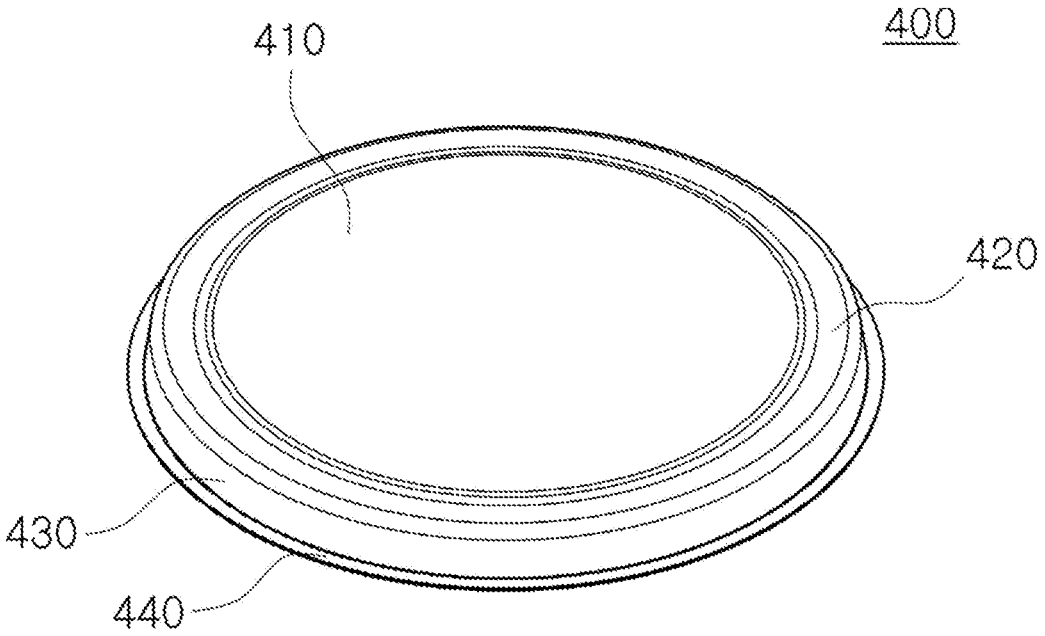
FIG. 9 is a perspective view illustrating the mesh member of a compact cosmetic case according to an embodiment of the invention.

The mesh member 400 may include a mesh that has a small thickness and in which multiple pores are formed. The mesh member 400 can be arranged over the membrane part 350 to be exposed at the access hole 615 of the lid member 600. Referring to FIG. 9, the mesh member 400 can include an exposed mesh 410, an edge part 420, a coupling rim 430, and a flange part 440.

The exposed mesh 410 is the main part of the mesh member 400 and corresponds to the portion that is exposed at the top through the access hole 615 of the lid member 600. Numerous pores can be formed over the entire exposed mesh 410 or at least over the positions corresponding to the slits 355 of the membrane part 350. The exposed mesh 410 can have a radius of curvature corresponding to that of the rubber member 300 of the membrane part 350, so as to maintain contact with the membrane part 350, and can have a small thickness that allows the exposed mesh 410 to be elastically deformed as well when the membrane part 350 is elastically deformed.

The edge part 420 can be formed along the edge of the exposed mesh 410 and can connect the exposed mesh 410 with the coupling rim 430. The shape and size of the edge part 420 may vary depending on the coupling structure of the rubber member 300 and the container body 500, and in certain embodiments, the edge part 420 may even be omitted.

The coupling rim 430 and the flange part 440 can be used for coupling the mesh member 400 to the container body 500. The coupling rim 430 can protrude downward from the edge of the edge part 420, and the flange part 440 can protrude outward from a lower portion of the coupling rim 430. As illustrated in FIG. 4, the coupling rim 430 of the mesh member 400 can be secured between the inner rim 570 of the container body 500 and the inner rim 630 of the lid member 600, and the flange part 440 can be secured between the bridge part 560 of the container body 500 and the inner rim 630 of the lid member 600.

When the user pushes down on the membrane part 350 with a puff 650 to use the content (not shown), the user may press the exposed mesh 410 of the mesh member 400 and the membrane part 350 of the rubber member 300 that are exposed through the access hole 615 of the lid member 600. The exposed mesh 410 and the membrane part 350 can move downward while being elastically deformed, and the content (not shown) within the holding space 205 can pass through the slits 355 to be provided over the membrane part 350.

Here, since the exposed mesh 410 of the mesh member 400 is in contact with the membrane part 350 of the rubber member 300 and there are numerous pores formed in the exposed mesh 410, the content (not shown) that has passed through the slits 355 can be provided over the exposed mesh 410 of the mesh member 400. When the user removes the force on the membrane part 350, the exposed mesh 410 and the membrane part 350 can both return to their original positions together, but the content (not shown) that has passed through the slits 355 may remain on the exposed mesh 410. The user can then use the puff 650 to dab and apply the content (not shown) that has been provided on the exposed mesh 410.

The slits 355 of the membrane part 350 can allow the content (not shown) to pass through when the membrane part 350 is pressed and moved down from its initial position. However, this means that, not only can the content pass through the slits 355 when the user is pushing down on the membrane part 350, but also the content provided over the membrane part 350 may possibly drop back through the slits 355 into the holding space 205 before the membrane part 350 returns to its initial position. In addition, the restoring of the membrane part 350 to its initial position would cause an increase in the volume of the holding space 205 and hence a decrease in pressure, so that the resulting negative pressure within the holding space 205 may suction the content back into the holding space 205. The exposed mesh 410 can minimize the amount of content returning into the holding space 205 through the slits 355. That is, after a certain amount of content (not shown) has passed through the slits 355 to be provided on the exposed mesh 410 during the downward movement of the membrane part 350, a considerable amount of the content (not shown) may remain on the exposed mesh 410 due to its viscosity without dropping back into the holding space 205 through the slits 355 during the upward movement of the membrane part 350 involved in the elastic restoration of the membrane part 350.

Figure 10:
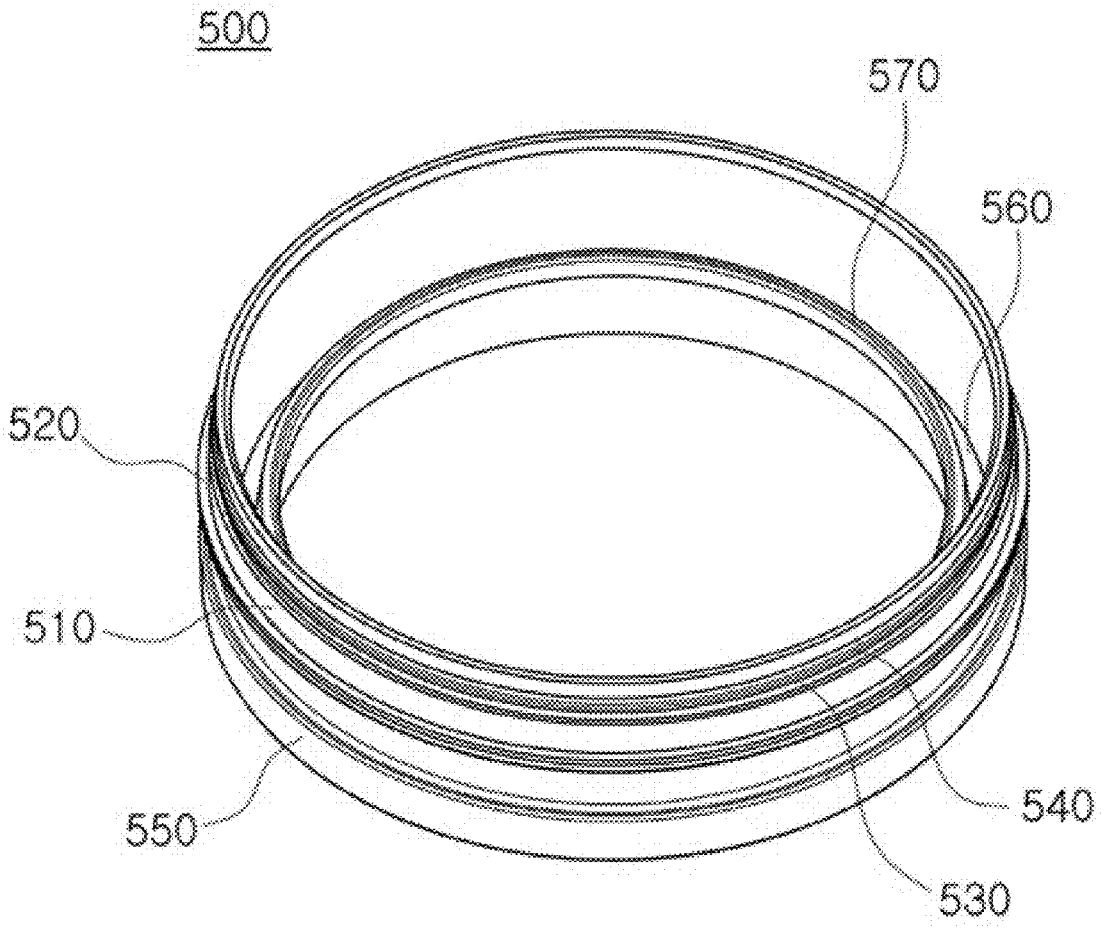
FIG. 10 is a perspective view illustrating the container body of a compact cosmetic case according to an embodiment of the invention.

The container body 500 corresponds to the main component of the compact cosmetic case 1000 t which other components may be coupled and can form the holding space 205 on its inner side. Referring to FIG. 10, the container body 500 can include a main shell 510, a ledge 520, a coupling rim 530, a lower rim 550, a bridge part 560, and an inner rim 570.

The main shell 510 corresponds to the main part of the container body 500. While the main shell 510 can have a generally cylindrical shape, it is not limited to a particular shape. The main shell 510 can be configured to be coupled to the lid member 600.

The ledge 520 can protrude outward from the outer perimeter of the main shell 510 at a particular height. When the lid member 600 is coupled to the container body 500, the lower end of the outer rim 620 of the lid member 600 can rest on the upper surface of the ledge 520. The degree to which the ledge 520 protrudes outward can be designed such that the outer perimeter of the ledge 520 is flush with the outer perimeter of the outer rim 620 of the lid member 600.

The coupling rim 530 can extend upward from the upper end of the main shell 510. The coupling rim 530 can have a smaller outer diameter than that of the main shell 510 and can be inserted between the outer rim 620 and inner rim 630 of the lid member 600. A coupling protrusion 540 can be formed at a particular height of the coupling rim 530, where the coupling protrusion 540 can protrude outward from the outer perimeter of the coupling rim 530. Since the coupling protrusion 540 protrudes outward, the gap between the main shell 510 and the coupling protrusion 540 can form a type of groove, and a coupling protrusion provided on the inner perimeter of the outer rim 620 of the lid member 600 can be inserted in this groove. The coupling protrusion 540 of the container body 500 can be inserted into a coupling groove formed in the inner perimeter of the outer rim 620 of the lid member 600.

The lower rim 550 can be formed on a lower portion of the main shell 510. The lower rim 550, together with the inner rim 570, can be used for coupling and securing the base member 100 and the rubber member 300 to each other. When the container body 500 is coupled to the lower case 200, the lower end of the lower rim 550 can rest on the step 232 of the support part 230 of the lower case 200. A coupling groove can be formed in the inner perimeter of the lower rim 550, and when the base member 100 is coupled to the container body 500, the coupling protrusions 140 formed in the coupling rim 130 of the base member 100 can be inserted into the coupling groove formed in the inner perimeter of the lower rim 550.

The bridge part 560 is the part that connects the main shell 510 and the inner rim 570 at a lower portion of the main shell 510. When the lid member 600 is coupled to the container body 500, the lower end of the inner rim 630 of the lid member 600 can be supported on the upper surface of the bridge part 560. In certain embodiments, a multiple number of indentations (not shown) can be formed in the upper surface of the bridge part 560, and the spike protrusions 640 formed on the lower end of the inner rim 630 of the lid member 600 can be inserted into these indentations (not shown).

The inner rim 570 can extend up and down from an inner side of the bridge part 560. As illustrated in FIG. 4, the inner rim 570 can have an inclined cross section that narrows inwardly towards the top.

The inner rim 570 can define the holding space 205 on its inner side. However, as in the example illustrated in FIG. 4, the support wall 340 of the rubber member 300 can tightly contact the inner rim 570, so that the part where the content (not shown) is actually housed within the holding space 205 can correspond to the inner side of the rubber member 300.

As described above, the coupling rim 130 of the base member 100 and the coupling rim 330 of the rubber member 300 can be inserted between the lower rim 550 of the container body 500 and the lower end 580 of the inner rim 570. A coupling protrusion can be formed on the outer perimeter of the lower end 580 of the inner rim 570 to help prevent the rubber member 300 from becoming detached.

Of course, it is possible to implement a compact cosmetic case 1000 according to an embodiment of the invention without including a base member 100, and it is possible to implement a compact cosmetic case 1000 according to an embodiment of the invention without including the coupling rim 330 or the support wall 340 of the rubber member 300. In such cases, the structure of the container body 500 can be modified correspondingly.

Although it is not illustrated in the drawings, a separate immersion member (not shown) can be arranged within the holding space 205 in certain embodiments of the invention. The immersion member (not shown) can have a bottom surface that is shaped in correspondence with the upper surface of the holder part 110 of the base member 100 and an upper surface that is shaped in correspondence with the bottom surface of the membrane part 350, so as to almost completely occupy the inside of the holding space 205.

In cases where the content held within the holding space 205 is a liquid, the liquid content can be provided immersed within an immersion member (not shown) made of a porous material such as a sponge, etc. When the user presses the membrane part 350, the liquid content immersed in the immersion member (not shown) can be provided through the slits 355 of the membrane part 350 onto the membrane part 350 and exposed mesh 410. In such cases, the exposed mesh 410 can be a mesh to which a hydrophobic treatment has been applied. Thus, the liquid content that passes through the pores of the exposed mesh 410 to be provided on the exposed mesh 410 may mostly be prevented from passing back through the pores due to the hydrophobicity of the exposed mesh 410. The liquid content can thus remain on the exposed mesh 410 in the form of droplets, due to its own surface tension.

Figure 11:
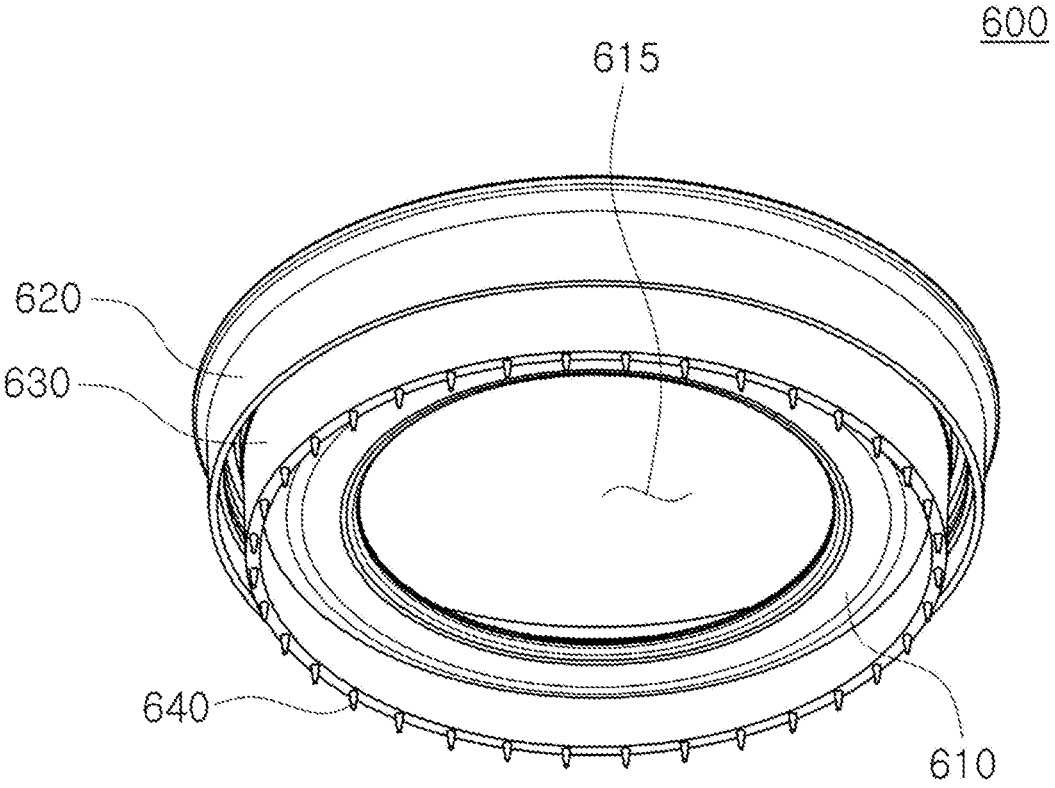
FIG. 11 is a perspective view illustrating the lid member of a compact cosmetic case according to an embodiment of the invention.

The lid member 600 can be coupled to an upper portion of the container body 500 to form a space for a puff 650, etc., under the upper case 700. Referring to FIG. 11, the lid member 600 can include a holder part 610, an outer rim 620, and an inner rim 630. Incidentally, FIG. 11 shows the lid member 600 from below.

The holder part 610 can form a space for housing the puff 650 on its inner side. For example, the holder part 610 can form a space that is open at the top by way of a curved cross section such as that shown in FIG. 4. Also, an access hole 615 can be formed in the middle in a lower portion of the holder part 610. When the lid member 600 is coupled to an upper portion of the container body 500, portions of the exposed mesh 410 and the membrane part 350 can be exposed to the exterior through the access hole 615, and the user can press the exposed mesh 410 and the membrane part 350 that are exposed through the access hole 615.

The outer rim 620 can extend downward from an outer side of the upper portion of the holder part 610. The outer rim 620 can have an annular shape and can be used in the coupling between the lid member 600 and the container body 500. A coupling protrusion can be formed in the inner perimeter of the outer rim 620, where the coupling protrusion can be inserted into the groove between the coupling protrusion 540 and main shell 510 of the container body 500. A coupling groove can also be formed in the inner perimeter of the outer rim 620, and the coupling protrusion 540 of the container body 500 can be inserted into this coupling groove.

The inner rim 630 can extend downward from a lower portion of the holder part 610 and can be formed at a more inner position compared to the outer rim 620. The inner rim 630 can also have an annular shape and can be used in the coupling between the lid member 600 and the container body 500. The inner rim 630 can also be used in securing the mesh member 400 onto the container body 500. For example, the inner rim 630 can be forcibly inserted between the main shell 510 and inner rim 570 of the container body 500, where the coupling rim 430 of the mesh member 400 can be secured between the inner rim 630 of the lid member 600 and the inner rim 570 of the container body 500, and the flange part 440 of the mesh member 400 can be secured between the inner rim 630 of the lid member 600 and the bridge part 560 of the container body 500.

One or more spike protrusions 640 can be formed on the lower end of the inner rim 630. The spike protrusions 640 can have a generally conical shape with the point facing downwards. The mesh member 400, which may be made as a thin layer, can be effectively secured in its correct position as the flange part 440 is pressed by the pointy ends of the spike protrusions 640. As described above, indentations (not shown) into which the lower ends of the spike protrusions 640 can be inserted may be formed in the upper surface of the bridge part 560 of the container body 500 at positions corresponding to the spike protrusions 640.

The upper case 700 can be coupled to the lower case 200 to form a portion of the exterior of the compact cosmetic case 1000. Referring to FIG. 4, the upper case 700 can include an upper plate 710, a side wall 720, a hinge-connecting part 730, and a hinge 740.

The upper plate 710 can be formed in a flat shape with an area sufficient to cover over the lid member 600. The upper plate 710 can be formed at a position separated by a particular distance from the holder part 610 of the lid member 600, so as to form a gap between the upper plate 710 and the holder part 610 where the puff 650, etc., may be stored. A mirror 712 can also be attached to the bottom side of the upper plate 710.

The side wall 720 can extend downward from the edge of the upper plate 710 and can form the side surface of the upper case 700. At a position corresponding to the push button 250 in the inner perimeter of the side wall 720, an indentation can be formed which the release protrusion of the push button 250 may engage.

The hinge-connecting part 730 and the hinge 740 can be provided on the rear side of the side wall 720. The hinge-connecting part 730 can extend downward to a particular distance from the side wall 720, and the hinge 740 can be provided on the lower end of the hinge-connecting part 730. The hinge-connecting part 730 can be placed within the clearance indentation 220 of the lower case 200. A hinge pin (not shown) can penetrate the hinge 740 of the upper case 700 through the coupling holes 225 of the lower case 200, thereby allowing the upper case 700 to rotate about the hinge 740 in relation to the lower case 200.

According to an embodiment of the invention set forth above, the membrane part 350 and the slits 355 can be configured such that the content stored in the holding space 205 is not easily spilled to the exterior when the user does not wish to use the content but is easily dispensed to the exterior when the user does wish to use the content. In particular, since the slits 355 can maintain a closed state when the membrane part 350 is not pressed, the amount of content spilled out unintentionally would be significantly reduced even when the upper case 700 is opened unexpectedly or when an impact is applied on the compact cosmetic case 1000. These features can be especially useful when the content is a powder, cream, gel, liquid, etc.

Also, according to an embodiment of the invention set forth above, an exposed mesh 410 may be arranged over the membrane part 350, so that most of the content that has passed through the slits 355 may continue to remain on the membrane part 350. That is, when the membrane part 350 is pressed and is in a deformed state, the slits 355 may be opened, so that the content can be dispensed onto the membrane part 350, but there is a risk of the content falling back into the holding space 205 or being suctioned back due to the negative pressure within the holding space 205 as the membrane part 350 is returned to its original position. The exposed mesh 410 of the mesh member 400 can minimize the amount of content returning to the holding space 205, to ensure a sufficient amount of content remains provided for the user.

In particular, according to an embodiment of the invention, the base member 100, rubber member 300, mesh member 400, and container body 500, which enable the advantages described above, may be configured to not only be coupled to one another in a strong and watertight manner but also be easily assembled. At portions contacting the container body 500, the rubber member 300 and the base member 100 may have inclined surfaces corresponding to the direction of insertion, and such inclined surfaces both allow easier assembly and refill processes and, after the components are coupled, provide a stronger sealing performance as the base member 100 and the container body 500 compress the rubber member 300. Since the mesh member 400 may be coupled to the container body 500 at a position different from that for the rubber member 300, the user can refill the content in the holding space 205 without having to separate the mesh member 400.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A compact cosmetic cases comprising:

a container body having a holding space positioned at an inner side thereof, the holding space having an open top, the container body having an inner rim and a lower rim, the holding space being positioned at an inner side of the inner rim, the inner rim and the lower rim being connected to each other by a bridge part, the lower rim extending downward from the bridge part, a lower end of the inner rim being spaced apart from a lower end of the lower rim;

a rubber member coupled to the container body and including a membrane part, a support wall, and a first coupling rim, the membrane part covering the open top of the holding space and having at least one slit defined therein, the support wall extending downward from an edge of the membrane part, the first coupling rim extending upward from an edge of the support wall; and a base member coupled to a lower portion of the container body to close a bottom of the holding space, the base member having a second coupling rim extending upward from an edge of the base member, the first coupling rim and the second coupling rim being fitted between the inner rim and the lower rim such that the first coupling rim of the rubber member is compressed when pressed in-between the second coupling rim of the base member and the inner rim of the container body, wherein the membrane part, the support wall, and the first coupling rim are formed from an elastically deformable material.

2. The compact cosmetic case of claim 1, wherein the at least one slit includes a plurality of slits, each extending radially with respect to a predetermined point of the membrane part, the predetermined point being a center of the plurality of slits, and the membrane part has an increased thickness at the predetermined point.

3. The compact cosmetic case of claim 1, further comprising:

a mesh member arranged over the membrane part and having a plurality of pores, the mesh member having a portion secured to the container body; and a lid member coupled to an upper portion of the container body and having an access hole positioned in a middle thereof, the access hole being positioned above the holding space, wherein a portion of the mesh member is secured between the lid member and the container body, and a plurality of downwardly protruding spike protrusions are positioned on a part of a lower portion of the lid member contacting the mesh member.

4. The compact cosmetic case of claim 1, further comprising:

a lower case coupled to the container body; and an upper case separably coupled to the lower case.

5. The compact cosmetic case of claim 1, further comprising:

an immersion member arranged within the holding space and configured to have a liquid content immersed therein.

6. The compact cosmetic case of claim 5, further comprising:

a mesh member having a plurality of pores, with a portion of the mesh member arranged over the membrane part, the mesh member having a portion secured to the container body, wherein the portion of the mesh member arranged over the membrane part has a hydrophobic treatment applied thereto.

7. The compact cosmetic case of claim 1, wherein the slit is configured such that at least one of a shape and a size of the slit changes in response to a pressure applied from above on the membrane part.

* * * * *